United States Patent [19]

Rosato

[11] Patent Number: 4,586,909

[45] Date of Patent: May 6, 1986

[54] INBOARD/OUTBOARD MOTOR BELL HOUSING COVER

[76] Inventor: Charles Rosato, 37 Beach Ave., Copiague, N.Y. 11726

[21] Appl. No.: 612,624

[22] Filed: May 21, 1984

Related U.S. Application Data

[63] Continuation-in-part of Ser. No. 355,122, Mar. 5, 1982, abandoned.

[51] Int. Cl.[4] ..... B63H 23/32

[52] U.S. Cl. ..... 440/112; 440/113

[58] Field of Search ..... 440/49, 53–64, 440/111, 112, 113, 900; 114/65 R, 174, 201 R, 221 R, 227, 361; 220/3.8; 49/463, 465; 244/129.4

[56] References Cited

U.S. PATENT DOCUMENTS

| | | | |
|---|---|---|---|
| 3,140,344 | 7/1964 | Slater et al. | 220/3.8 |
| 3,220,374 | 11/1965 | Sloan | 440/112 |
| 3,364,509 | 1/1968 | Lapworth | 114/357 |
| 3,368,517 | 2/1968 | MacDonald et al. | 440/57 |
| 3,460,506 | 8/1969 | Johns et al. | 440/57 |
| 3,716,815 | 2/1973 | Riches | 220/3.8 |
| 4,193,507 | 3/1980 | Wise et al. | 150/52 R |
| 4,265,365 | 5/1981 | Boteler | 220/3.8 |
| 4,399,965 | 8/1983 | Walker | 244/129.4 |

*Primary Examiner*—Sherman D. Basinger
*Assistant Examiner*—Stephen P. Avila
*Attorney, Agent, or Firm*—William J. Eppig, Esq.

[57] ABSTRACT

A cover is designed for the majority of MerCrusier inboard/outboard motor bell housings which is conveniently attached using the existing studs exposed when the lower unit is removed. The non weather-proof parts being exposed when the lower unit is removed are thereby protected while in dry dock or when the boat is returned to the water without the lower unit.

4 Claims, 4 Drawing Figures

INBOARD/OUTBOARD MOTOR BELL HOUSING COVER

FIELD OF INVENTION

This application is a continuation-in-part of a prior application, Ser. No. 355,122 filed 03/05/82 now abandoned.

This invention relates to a protective cover for MerCrusier inboard/outboard motors that are partially disassembled, that is, have their "lower unit" or propeller assembly removed for repairs or winter storage. Occassionally, after the lower unit is removed, the boat must be placed back into the water. The protective cover then prohibits the sea water from seponing through the exposed exhaust ports and into the engine.

BACKGROUND AND DISCUSSION OF THE PRIOR ART

Owners of MerCrusier (MerCrusier is a register trademark of Mercury Outboards) inboard/outboard motors are faced with the problem of protecting certain non-weatherproof parts that become exposed when the lower unit or propeller assembly is disconnected from the bell housing. This usually occurs when the boat in which the inboard/outboard (I/O) is placed, is removed from the water and placed in dry dock for repairs or winter storage. In winter storage, for example, this lower unit is removed to protect it from being damaged or stolen and it is placed indoors in a secure area to be reassembled in the spring time. An additional problem occurs when the lower unit is removed for repairs and usually because their is no space available on land to store the boat. While the repairs are being made, the boat must be returned to the water absent the lower unit. When the lower unit is removed, the weather proofing and water proofing that it provides is removed with it. This allows sea water to siphon back through the exhaust ports and into the engine, when the boat is returned to the water absent the lower unit.

The problem is therefore two fold: First, to protect the bearings and shifting mechanism that are exposed to the weather by the removal of the lower unit; and second, to waterproof the exhaust ports after removal of the lower unit to permit the boat to be return to the water absent the lower unit.

In the past, boat owners would attempt to cover the bell housing by taping plastic bags over it. This system proved unsatisfactory because the plastic bag would not hold up for the duration of the winter storage and, moreoften, the tape would be an ineffective means to hold the cover in place for the period of winter storage and through the course of the severe winter weather conditions. The plastic bag method was totally ineffective in water proofing the disassembled unit making returning a boat with a moved lower unit to the water impossible.

Now there is provided by the present invention a protective cover which effectively protects the exposed parts contained in the bell housing and simultaneously water proofs the exhaust ports until such time as the lower unit is put back into position.

It is therefore a principle object of the present invention to provide a weatherproof protective cover for an I/O bell housing.

It is another object of the invention to provide a waterproof protective cover for a I/O bell housing.

It is another object of the invention to provide a cover that is reuseable and inexpensive to manufacture. It is yet another object of the invention to provide a cover that is attached and held into position using the existing studs and nuts used to attach the lower unit.

DESCRIPTION OF THE PREFERRED EMBODIMENT

Figure 1:
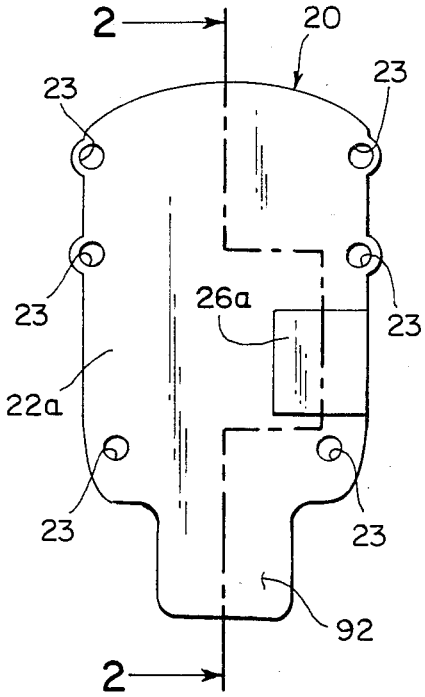
FIG. 1 is a view of the cover showing the outer surface.
Figure 2:
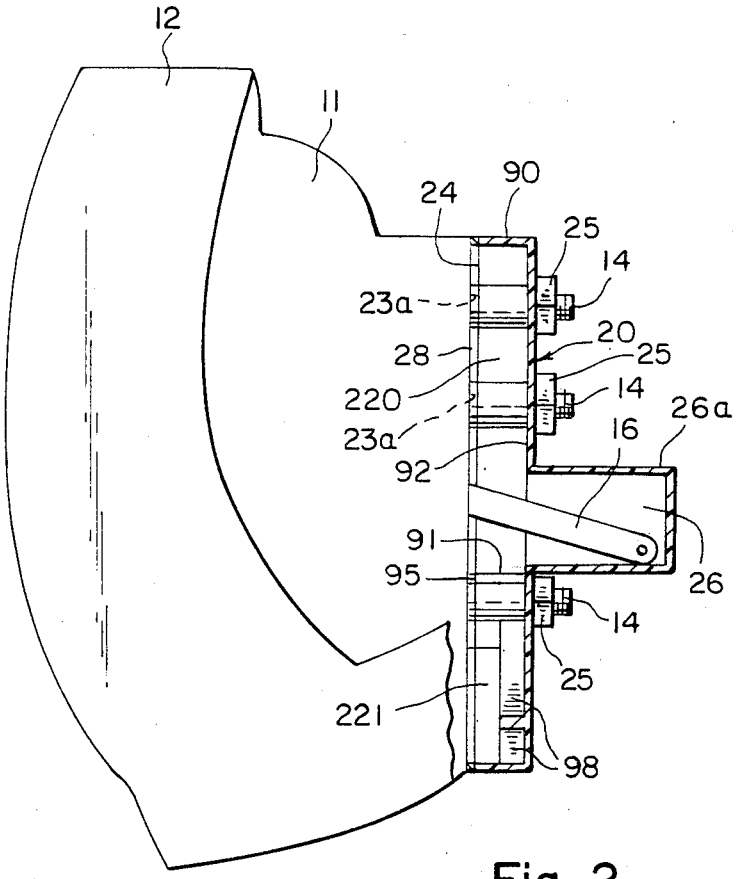
FIG. 2 is a sectional view, taken along line 2—2 of FIG. 1, with the cover attached to the bell housing.
Figure 3:
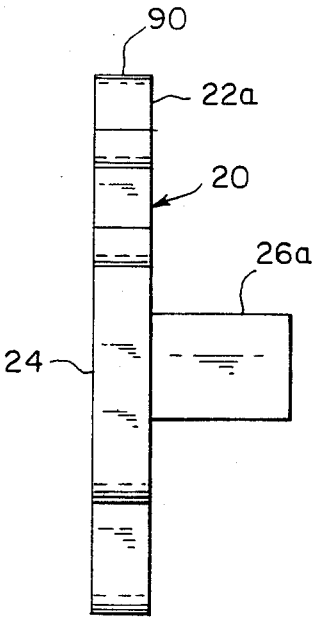
FIG. 3 is a side elevational view of the cover of FIG. 1.
Figure 4:
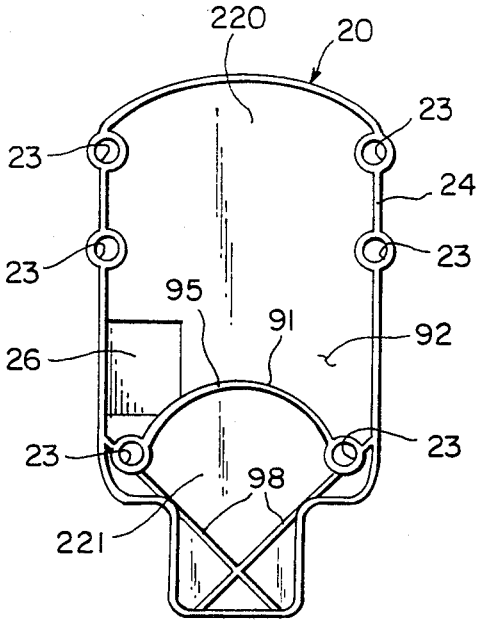
FIG. 4 is a top plan view of the inside or cavity of the cover.

Referring to the FIG. 2, one can see the very popular MerCrusier inboard/outboard bell housing. (The bell housing referred to herein is actually the assembly of the bell housing 12 and the gimbal 11.) The bearing (not shown) and shifting mechanism 16 are key elements in the bell housing that are covered by-cover 20 of the present invention.

The cover 20 is shaped to fit over the exposed elements. There are two protrusions. The first protrusion **22*a*, extends from the lip 24 out along the edge wall 90 a distance measured to accomodate use of the existing studs 14. These studs are not threaded their entire length so that when they pass through the holes 23 of the cover, the edge wall 90 is sufficiently wide to allow only the threaded part of the stud 14 to appear outside of the cover 20 to then be secured in place by the nuts 25. This first protrusion forms a cavity on the inside of the cover which cavity is divided by barrier wall 91 to form upper cavity 220 and lower cavity 221**.

The second protrusion **26*a* which is adjacent to a portion of the edge wall 90 forms a second cavity 26 which is substantially deeper than the first cavity 22*a*. This second cavity 26 is positioned to accept the shift mechanism 16 which extends well pass the length of the studs 14**.

The edge wall 90, on the end opposite to the lip 24, is connected to the second protrusion **26*a* by the back wall 92 of the cover 20** forming a one-piece construction.

The edge wall 90 is contoured to follow the peripheral edge of the bell housing as the lower unit did before it was removed. The barrier wall 91 is the same height as the edge wall 90. The soft plastic gasket 28 is then shaped to contour the lip 24 and the lip 95 which is the top of the barrier wall 90. With the cover in place, the upper cavity 220 is isolated from the lower cavity 221 and is water tight. This is important if the boat with the lower unit removed is placed back into the water. The lower cavity 221 is not water tight because of the open exhaust ports (not shown) and immediately fill with water. With the placement of the barrier wall 91, the sea water cannot seep from the lower cavity 221 to the upper cavity 220 and into the back of the engine (not shown).

The back wall 92 of the lower cavity 221 is reinforced with walls 98 which are less than the height of the edge wall 90.

They extend into the lower part of cavity 221 from the base of the two lowest holes 23. Since these are the lowest holes, reinforcing the bottom of cavity 221 became essential because water pressure from inside the cavity caused the plastic cover to flex in turn causing the cover to crack and water to leak into cavity 220.

The edge wall 90 is also contoured to form the holes 23. As was previously explained, they are of the same height as the edge wall to provided spacing for the threaded portion of the studs 14. Since the studs 14 are positioned inside the peripheral edge of the bell housing, the holes 23 are according spaced from the edge wall 90. The gasket 28 also is shaped to contour the holes 23 by forming holes 23*a*.

What is claimed is:

1. A combination comprising:

(a) an inboard/outboard motor bell housing having a lower unit attached by the housing studs to said bell housing with a shift assembly protruding from said bell housing after the removal of the lower unit and an opening being formed by said removal of said lower unit; and (b) a cover being formed with a lip and being formed so as to provide a first cavity and a second cavity being substantially deeper than said first cavity and being formed with a plurality of holes, said holes being sized and spaced to match the studs of said housing; said cover being formed with a peripheral edge wall; whereby with mounting said cover to the bell housing through said studs and holes, the shift assembly of said housing protrudes into the second cavity and said opening is covered as if the lower unit was in place;

(c) said cover further comprising a barrier wall being transversely disposed in said first cavity to separate said first cavity into an upper section and lower section, said cover fitting into said housing opening; and (d) said peripheral edge wall being contoured to form a plurality of said holes, and said barrier wall being contoured to form a second plurality of said holes.

2. The protective cover of claim 1, said cover further comprising a gasket disposed around the lip and forming a weather seal between the cover and bell housing.

3. The protective cover of claim 2, means to affix said gasket to the lip of the cover.

4. The protective cover of claim 2, said lip extending around the periphery of said cover member.

* * * * *